US005360488A

United States Patent [19]

Hieatt et al.

[11] Patent Number: 5,360,488

[45] Date of Patent: Nov. 1, 1994

[54] METHOD OF CLEANING AND MAINTAINING WATER DISTRIBUTION PIPE SYSTEMS

[75] Inventors: Allen C. Hieatt, Mesa; Jerome H. Ludwig, Paradise Valley, both of Ariz.

[73] Assignee: H.E.R.C. Products Incorporated, Phoenix, Ariz.

[21] Appl. No.: 36,188

[22] Filed: Mar. 23, 1993

[51] Int. Cl.[5] ..... B08B 9/02; B08B 9/06

[52] U.S. Cl. ..... 134/22.11; 134/22.12; 134/22.13; 134/22.14

[58] Field of Search ..... 134/22.12, 22.14, 22.13, 134/22.11, 3, 10, 41; 137/240

[56] References Cited

U.S. PATENT DOCUMENTS

| | | | |
|---|---|---|---|
| 1,194,542 | 8/1916 | Raymond . | |
| 1,892,093 | 12/1932 | Battistella . | |
| 3,169,545 | 2/1965 | Kolling | 134/22.12 X |
| 3,281,268 | 10/1966 | Martin | 134/22.14 X |
| 3,424,688 | 1/1969 | Boiko et al. | 252/87 |
| 3,527,609 | 9/1970 | Vinso | 134/3 |
| 3,969,255 | 7/1976 | Connelly, Jr. | 134/22.14 X |
| 4,025,359 | 5/1977 | Connelly, Jr. | 134/3 |
| 4,220,550 | 9/1980 | Frenier et al. | 252/180 |
| 4,276,185 | 6/1981 | Martin | 134/3 X |
| 4,541,945 | 9/1985 | Anderson et al. | 252/149 |
| 4,780,150 | 10/1988 | Anderson et al. | 134/3 |
| 4,789,406 | 12/1988 | Holder et al. | 134/3 |
| 4,806,169 | 2/1989 | Spane et al. | 134/3 |
| 4,818,298 | 4/1989 | Shishkin et al. | 134/22.14 X |
| 4,872,919 | 10/1989 | Bucher et al. | 134/3 |
| 4,971,631 | 11/1990 | Sallee et al. | 134/3 |
| 5,045,352 | 9/1991 | Mueller | 134/3 X |
| 5,199,995 | 4/1993 | Shoji et al. | 134/2 |

*Primary Examiner*—Richard O. Dean
*Assistant Examiner*—Saeed Chaudhry
*Attorney, Agent, or Firm*—Wood, Herron & Evans

[57] ABSTRACT

A method of cleaning and maintaining water distribution systems which have reduced flow due to an increase of water scale deposits, sediment, and the like on the inside surface of the pipe is disclosed. An aqueous acidic cleaning solution is introduced and circulated through the pipe to be treated for a sufficient time to dissolve and loosen the scale and sediment, and the spent solution containing dissolved or suspended scale and sediment is flushed from the pipe to provide a cleaned pipe with improved water flow. It is also desirable to flush the water distribution pipe system with high pressure water after the treatment to remove loosened scale and sediment that was not removed during the circulation and flushing of the treating solution.

11 Claims, 1 Drawing Sheet

METHOD OF CLEANING AND MAINTAINING WATER DISTRIBUTION PIPE SYSTEMS

BACKGROUND OF THE INVENTION

It is well known that hardness and suspended solids in water sources vary widely in composition depending on the source and will result in scale deposition and sedimentation on surfaces wherever water is used. Scale deposition and sedimentation is particularly troublesome in water distribution pipe systems which service the residential and commercial customers of municipalities, private water companies and the like along with industrial process water distribution pipe systems as found in the mining, petroleum, agriculture and the like industries. In these systems, the formation of scale and sediment can reduce the water flow through the pipe system which will limit the capacity of the pipe to service the requirements of the customers or to provide the required water necessary for an industrial process, irrigation, etc. For instance, in municipal systems an increase in the fire risk would be obvious if the fire hydrant did not supply sufficient water to extinguish the fire due to scale and sediment deposits in the feed pipe line. At some point, the water distribution pipe would have to be replaced due to these restrictions at a high cost and with prolonged interruption of service.

Additionally, scale and sedimentation will increase the possibility of corrosion in the water distribution pipe along with promoting the growth of organisms. The organisms also can be a health hazard, promoting corrosion and biomass which binds scale and sediment together and to the surfaces of the system. Corrosion will eventually lead to the leakage of the system and the necessity to replace the leaking section.

Strong acids have been used to clean water wells, however, submersible pumps are removed prior to treatment to prevent corrosion by the acids employed. Also, organic acids, mixtures of mineral acids and organic acids or inhibited acid compositions have been found to clean water wells without the necessity of removing the pumps or other equipment. These methods for cleaning water wells have involved static and surging treatment.

A proper cleaning and maintenance program for water distribution systems will prevent decreased water flow capacity, corrosion and the necessity to replace the system or portions thereof. A simple and effective method for cleaning and maintaining these systems is needed.

SUMMARY OF THE INVENTION

This invention is directed to a method of cleaning and maintaining water distribution systems. Water systems having interior scale and sediment deposits are cleaned by introducing and circulating an effective amount of an aqueous treatment solution for a sufficient period of time which results in the solution, loosening and suspension of the undesired scale and sediment. Thereafter, the spent treating solution containing the dissolved or suspended scale and sediment is flushed from the water distribution system to provide a clean system with improved water flow and operation. Additionally, further flushing with high pressure water will also remove additional scale that had been loosened by the treating solution.

The cleaning solution may be acidic, neutral or basic. In the most preferred form, in potable water pipe systems, mineral acids or organic acids, and mixtures thereof, are employed as acidic treatment solutions. The acidic treatment solution may contain further additives such as inhibitors, chelating agents, penetrating and/or dispersing agents to assist in the removal of scale and sediment and to minimize any adverse effects on the pipes, valves, or other system surfaces due to the acids employed.

This invention provides a simple, low cost and effective method of removing water scale and sediment from water distribution systems in order to maintain proper water flow, operation and to prevent corrosion of the system which would require the high cost and inconvenience of replacement.

Other advantages and objectives of this invention will be further understood with reference to the following detailed description and drawings.

DETAILED DESCRIPTION OF THE INVENTION

Among the acidic treatment solutions found to be useful in practicing the method of this invention are aqueous solutions of mineral acids such as hydrochloric, nitric, phosphoric, polyphosphoric, hydrofluoric, boric, sulfuric, sulfurous, and the like. Aqueous solutions of mono-, di- and polybasic organic acids have also been found to be useful and include formic, acetic, propionic, citric, glycolic, lactic, tartaric, polyacrylic, succinic, p-toluenesulfonic, and the like. The useful treatment solutions may also be aqueous mixtures of the above mineral and organic acids.

Alkaline, acid, or neutral cleaning solutions may also be employed, as indicated above, depending upon the type of scale that needs to be removed. Sequestering or chelating agents such as EDTA (ethylenediamine tetraacetic acid), NTA (nitrilotriacetic acid), and derivatives, i.e., basic alkali salts, and the like have also been found to be useful in the treatment solution in certain cases.

The acidic treatment solution may also contain acid inhibitors which substantially reduce the acidic action on metal surfaces of the water distribution system, particularly valves, fire hydrants, etc., and these various inhibitors for acids have been well documented in the patent art. Typical, but not necessarily all inclusive, examples of acid inhibitors are disclosed in the following U.S. Pat. Nos. 2,758,970; 2,807,585; 2,941,949; 3,077,454; 3,607,781; 3,668,137; 3,885,913; 4,089,795; 4,199,469; 4,310,435; 4,541,945; 4,554,090; 4,587,030; 4,614,600; 4,637,899; 4,670,186; 4,780,150 and 4,851,149 which are incorporated herein by reference.

The treatment solution may also contain dispersing, penetrating or emulsifying agents to assist in the removal of the scale and sediment. These surface active agents may be anionic, cationic, nonionic or amphoteric as defined in the art. Compounds such as alkyl ether sulfates, alkyl or aryl sulfates, alkanolamines, ethoxylated alkanolamides, amine oxides, ammonium and alkali soaps, betaines, hydrotropes such as sodium aryl sulfonates; ethoxylated and propoxylated fatty alcohols and sugars, ethoxylated and propoxylated alkylphenols, sulfonates, phosphate esters, quarternaries, sulfosuccinates, and mixtures thereof, have been found to be useful in admixture with the acid treating solution.

DETAIL DESCRIPTION OF PREFERRED EMBODIMENT OF THE PRESENT INVENTION

Figure 1:
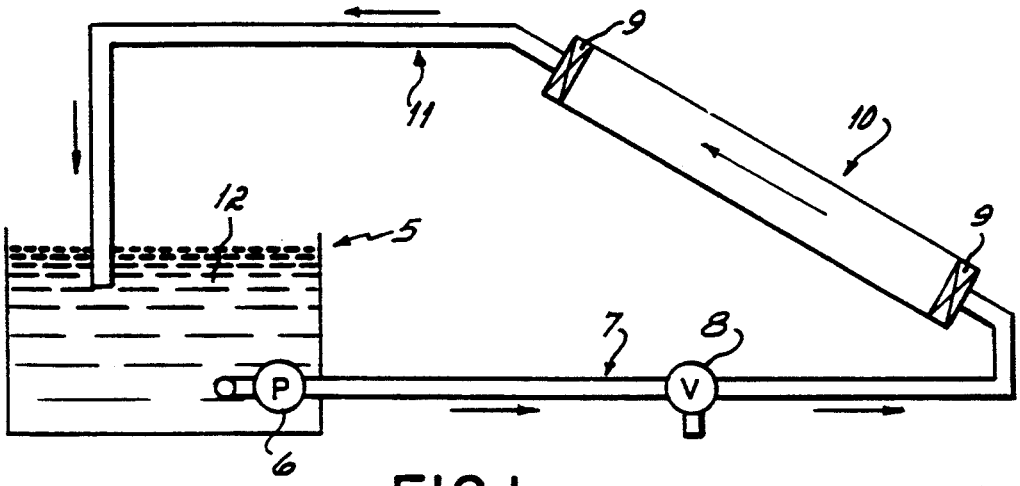
FIG. 1 is a schematic of a laboratory test system illustrating the method of this invention.

With reference to FIG. 1, a laboratory test system is shown to evaluate the removal of scale and sediment by acidic treating solutions from a test pipe sample taken from a water distribution system. This system includes a 15 gallon acidic treating solution reservoir 5, submersible acidic treating solution circulation pump 6 rated at 1200 gallons per hour, 1" inlet transfer line 7, drain valve 8, heavy rubber diaphragm seals 9 for the ends of the test pipe specimen 10, 1" outlet transfer line 11 and the treating solution 12. The test pipe specimen 10 is mounted at about a 30 degree angle so that the test solution will contact essentially the entire inner pipe surface to be treated.

A laboratory test, for example, was run on a four foot section of 6" diameter pipe which had been removed from a potable water distribution system that had been used for over 40 years. The scale on the inside of the pipe consisted of nodules of up to 1 to 1½ inches in height covering 100% of the inside pipe surface which had substantially reduced the opening inside the pipe for water to flow. Analysis of the scale indicated it consisted of primarily iron with some calcium, magnesium and manganese in the form oxides, hydroxides and carbonates along with fine mineral acid insoluble solids and some "biomass". This is typical scale associated with sulfate-reducing and iron bacteria along with the associated corrosion.

About 10 gallons of a 12.5% aqueous inhibited hydrochloric/glycolic acid solution containing a penetrating agent was placed in the reservoir 5 and circulated through the test pipe 10 for a period of 24 hours. After 2 hours of circulation, particles of the scale were breaking loose and could be heard in the outlet transfer line 11 and observed entering the reservoir 5. The color of the treating solution also became increasingly darker with circulation time. After 24 hours the circulation was stopped and the system was drained of the treating solution. The diaphragms 9 were removed and the inside of the test pipe was observed to be about 80% cleaned of scale and sediment solids.

On treating the test pipe with a second identical treating solution for a period of 21.5 hours, about 80% of the interior surface of the test pipe was observed to still be covered over with a scale and/or sediment that was a soft and paste-like semi-solid which contained some grit and could be easily removed with a probe. The remaining scale nodules had been substantially reduced in size since the end of the first treatment. It was concluded that the second treatment would probably not be necessary if a high pressure water flush was employed to remove the insoluble soft sediment which had coated the remaining scale nodules after the first treatment.

Figure 2:
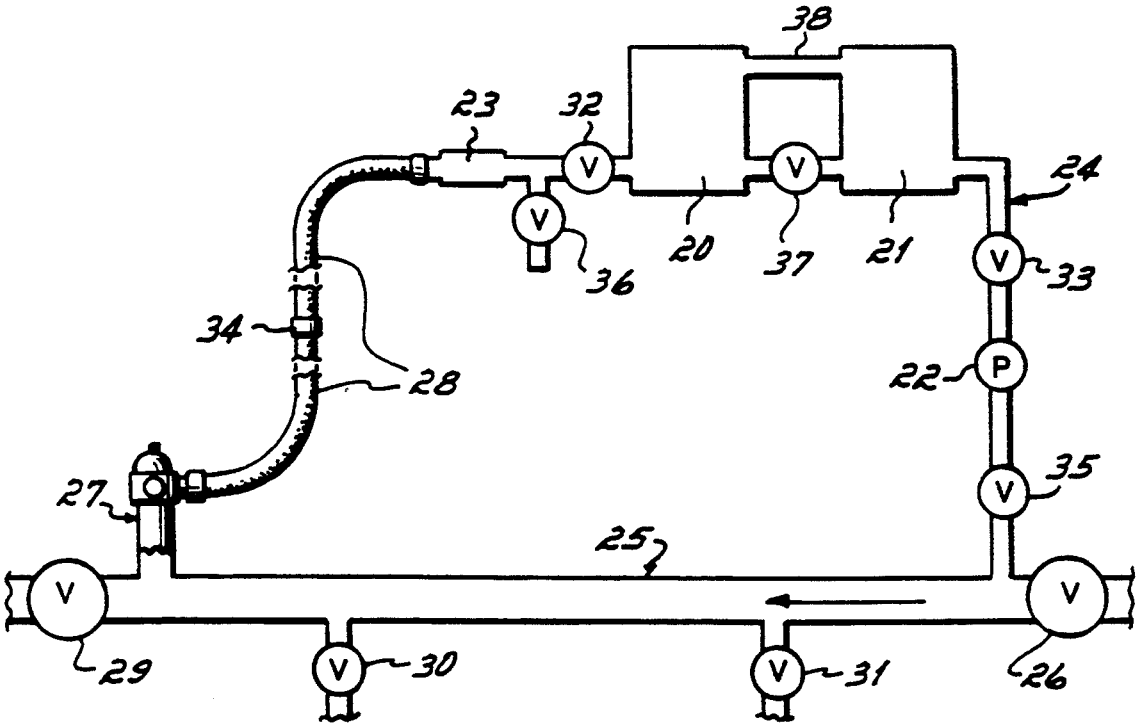
FIG. 2 is a diagram of a field system for cleaning a potable water distribution system.

With reference to FIG. 2, a field equipment and system diagram is shown which may be employed in the cleaning of a potable water pipe distribution system. Two 500 gallon treating solution reservoir tanks 20 and 21 along with a 100 gallon per minute circulation pump 22 and sight glass 23 are mounted on a flat bed truck (not shown). In this example, a 2½ inlet pipe 24 is secured to a 650 foot section of 6" water distribution pipe 25 after the main shut off valve 26. The fire hydrant 27 and fire hose 28 were employed for the acidic treating solution return to tanks 20 and 21.

The section of pipe 25 to be treated was isolated by closing off the two water main shut-off valves 26 and 29 along with all service line valves, typically 30 and 31. With valves 32 and 33 closed, 1000 gallons of acidic treating solution was prepared in tanks 20 and 21- With the coupling 34 open, the treating solution was allowed to enter the system by opening valves 33 and 35 and turning on the circulation pump 22. The pH of the water coming from the open coupling was then monitored until a decrease was noted which indicated the acid treating solution had displaced the water in the section to be treated. The circulation pump 22 was turned off and the coupling 34 connected. Valves 36 and 37 were then closed and valve 32 opened for circulation. The circulation pump 22 was then started again for the treatment period. Valve 37 was closed to allow for scale solids to accumulate in tank 20 while the treating solution could overflow at 38 to tank 21 which reduces the chances of plugging during treatment.

The treating solution was then circulated in the system of FIG. 2 for a period of 5 hours. Observation of the treating solution through the sight glass 23 showed an increasingly darker discoloration with time. At the end of the treatment period, the circulation pump 22 was turned off, and valves 33 and 35 were closed. The main shut-off valve 26 was slowly opened and fresh water allowed to enter the system until the treating solution was displaced as noted when the tanks 20 and 21 were full. Valve 32 was then closed. The fire hose 28 was then disconnected from the fire hydrant 27 and the main shut-off valve 26 opened full to allow high pressure flushing of the treated water main 25. As the flush water emerged from the fire hydrant 27 it was dark in color with considerable scale and sediment solids. Flushing continued until the flush water was clean of solids for a period of time prior to putting the treated section of the water distribution system back into service.

The flow rate through the fire hydrant 27 prior to treatment had been determined by a Pitot Gauge to be 588 gallons per minute. After treatment, the flow rate was determined to be 790 gallons per minute. This was an increase of 34.5%.

Also, improved mechanical operations of the hydrants and valves of the system were achieved. The flow of cleaning solution may also be reversed in the system to further improve cleaning efficiency. The above cleaning solutions met the requirements of the National Sanitation Foundation (NSF International, Ann Arbor, Mich.), Standard 60 for potable water distribution systems.

In view of the above detailed description, other method variations to clean domestic and industrial water distribution systems, like houses, hotels, plants, offices, etc., will be apparent to a person of ordinary skill in the art without departing from the scope of this invention.

What is claimed is:

1. A method of cleaning a water distribution pipe system comprising providing a reservoir for containing an aqueous treatment solution for the removal of scale associated with sulfate-reducing and iron bacteria consisting of primarily iron oxide, biomass and sediment from inside pipe surfaces of a water distribution pipe system, said solution selected from the group consisting of an acidic, neutral and basic solution, sealing off between two fire hydrants a section of pipe in said system for circulation of said cleaning solution therethrough, circulating said cleaning solution from said reservoir through said pipe section and returning said solution to said reservoir for the removal of said scale and sediment.

2. The method of claim 1 wherein said reservoir is truck mounted for makeup, storage and disposal of cleaning solution.

3. The method of claim 1 wherein said pipe distribution system is domestic or industrial water distribution system.

4. The method of claim 1 comprising the further step of flushing said pipe system with clean water after the removal of spent cleaning solution.

5. The method of claim 1 comprising the further step of flushing said pipe system with high pressure water for the removal of any spent cleaning solution, scale and/or sediment.

6. The method of claim 1 wherein said aqueous treatment solution is acidic.

7. The method of claim 6 wherein said acid solution contains further additives selected from the group consisting of acid inhibitors, chelating agents, surfactants, penetrating agents and dispersing agents, and mixtures thereof to assist in the removal of said scale and sediment.

8. The method of claim 6 wherein said acid is selected from the group consisting of mineral and organic acids and mixtures thereof.

9. The method of claim 8 wherein said mineral acid is selected from the group consisting of hydrochloric, nitric, phosphoric, polyphosphoric, hydrofluoric, boric, sulfuric, and sulfurous, and mixtures thereof.

10. The method of claim 8 wherein said organic acid is selected from the group consisting of formic, acetic, propionic, citric, glycolic, lactic, tartaric, polyacrylic, succinic, p-toluenesulfonic and mixtures thereof.

11. The method of claim 1 wherein said aqueous treatment solution meets the requirements of the National Sanitation Foundation Standard 60 for potable water distribution systems.

* * * * *